US006454522B2

(12) United States Patent
Sakamoto et al.

(10) Patent No.: US 6,454,522 B2
(45) Date of Patent: Sep. 24, 2002

(54) IMPELLER FOR CIRCUMFERENTIAL CURRENT PUMP

(75) Inventors: Yasuyuki Sakamoto; Naotaka Tatsuzawa, both of Kawaguchi (JP)

(73) Assignee: Enplas Corporation, Kawaguchi (JP)

( * ) Notice: Subject to any disclaimer, the term of this patent is extended or adjusted under 35 U.S.C. 154(b) by 20 days.

(21) Appl. No.: 09/819,730

(22) Filed: Mar. 29, 2001

(30) Foreign Application Priority Data

Mar. 31, 2000 (JP) ..... 2000-098612

(51) Int. Cl.[7] ..... F04D 5/00

(52) U.S. Cl. ..... 415/55.1; 415/200; 416/228; 416/237; 416/238

(58) Field of Search ..... 415/55.1, 55.2, 415/55.3, 55.4, 55.5, 55.6, 55.7, 200; 416/228, 237, 238

(56) References Cited

U.S. PATENT DOCUMENTS 5,407,318 A * 4/1995 Ito et al. ..... 415/55.1
5,762,469 A * 6/1998 Yu ..... 415/55.1

FOREIGN PATENT DOCUMENTS

EP 109550 A2 * 5/1984 ..... 415/55.1
JP 2-45690 A * 2/1990 ..... 415/55.1

* cited by examiner

*Primary Examiner*—Christopher Verdier
(74) *Attorney, Agent, or Firm*—Staas & Halsey LLP

(57) ABSTRACT

An impeller for a circumferential current pump is provided with a plurality of vanes, and each of the vanes has an upstream side surface and a downstream side surface in a rotating direction thereof and a center line between both these surfaces extends along a radial direction of a disc-shape member, the upstream side surface has a radially inside portion and a radially outside portion which are formed to be continuous so that the radially inside portion is in parallel to the center line and the radially outside portion is inclined forward in the rotating direction of the disc-shape member, and the downstream side surface is formed entirely to be parallel to the center line.

8 Claims, 12 Drawing Sheets

PRIOR ART

PRIOR ART

PRIOR ART

IMPELLER FOR CIRCUMFERENTIAL CURRENT PUMP

BACKGROUND OF THE INVENTION

The present invention relates to an impeller for a circumferential current pump, so-called wesco-pump, utilized as a fuel pump capable of being arranged in a tank (intank-type fuel pump, called hereinlater) of, for example, an automobile.

In the known art, there has been utilized an intank-type circumferential current pump capable of being easily mounted to a vehicle such as an automobile and being operative with low noise and at small pressure variation.

FIG. 19 is an illustrated front view, partially in section, showing a circumferential current pump of a conventional structure and FIG. 20 is a sectional view of FIG. 1 in an enlarged scale.

With reference to these FIGS. 19 and 20, a circumferential current pump 51 is one disposed in a fuel tank, not shown, and when an impeller 52 of the pump 51 is rotated by means of a motor 53, energy is applied to the fuel by vanes 54 formed to an outer periphery of the impeller 52 and a pressure of the fuel flowing into a pump passage 56 from a fuel inlet 55 is then increased. The thus pressure-increased fuel is drained on the side of an engine through a fuel drain port 57.

In such circumferential current pump 51, the shape of the vane constituting the inpeller 52 largely affects a pumping performance of the pump 51. Taking the above matter into consideration, the prior art further provides a conventional example (1) such as disclosed in Japanese Patent Laid-open Publication No. SHO 57-206795, which, as shown in FIG. 21 and FIGS. 22A and 22B, discloses an inpeller 52 having an arrangement in which an upstream side surface 60 in a rotational (rotating) direction of one vane 54 and a downstream side surface 61 in the rotational direction of another one vane 54 adjacent to the first (above) mentioned vane 54 are parallel to each other (in other words, opposing surfaces 60 and 61 of a vane groove 58 are parallel to each other).

The prior art still further provides conventional examples such as disclosed in Japanese Patent Laid-open Publication No. HEI 8-100780, which includes an example (2) such as shown in FIG. 23A showing an impeller 52 in which vanes 54, each having a constant thickness, is entirely bent and includes an example (3) such as shown in FIG. 23B showing an impeller 52 in which a front side end of a vane 54 having a constant thickness inclines forward in the rotational direction thereof. In these prior art examples (2), and (3), the length of the vane surface 60 (length of the vane 52 contacting the fuel) by which a centrifugal force is applied to the fuel and the pump drain pressure is increased.

The prior art still further provides conventional examples such as disclosed in Japanese Patent Laid-open Publication No. HEI 6-229388, which includes an example (4) such as shown in FIG. 24 showing an impeller 52, in which an upstream side surface 60 in the rotational direction of a vane 54 is formed entirely in a circular shape and a downstream side surface 61 in the rotational direction thereof extends linearly outward from a radially inner side of the vane 54 to thereby impart a kinetic energy directing to the rotational direction with respect to the fuel in the vane groove by the upstream side surface 60 and hence improve a pumping efficiency.

Further, since the impellers 52 of the respective conventional examples mentioned above always contact the fuels in the tanks, these impellers were formed of resin materials such as phenol resin or PPS resin having excellent resistance to solvent through an injection molding process, and after the injection molding, the side and outer circumferential surfaces were ground and finished so that dimensional performance and/or surface performance are within desired performance ranges, respectively.

The above mentioned prior art examples, however, have still provided the following defects or problems.

In the first example (1), the vane 54 of the impeller 52 is formed so as to provide a thickened portion towards the radially outside portion, so that, as shown in FIG. 22B, a mold is clamped by the vanes 54 which are contracted and deformed after the injection molding (deformation from the solid line position to the dotted line position). Hence, a (mold) releasing resistance at the time of releasing the impeller 53 from the mold is made large, and thus, there is a fear of being hard to remove the impeller 52 from the mold or causing an undesired deformation of the impeller 52 by the releasing resistance.

In the second and third examples (2) and (3), the shape or design of the vane 54 of the impeller 52 is changed to increase the pump drain pressure. However, in such examples, the pump drain pressure cannot be sufficiently increased, and accordingly, further improved technology has been required.

In the fourth example (4), the pumping efficiency is improved by changing the shape or design of the vane 54 of the impeller 52. However, in this example, the pumping efficiency cannot be sufficiently increased, and accordingly, further improved technology has been required.

SUMMARY OF THE INVENTION

An object of the present invention is to substantially eliminate defects or drawbacks encountered in the prior art mentioned above and to provide an impeller for a circumferential current pump.

This and other objects can be achieved according to the present invention by providing, in one aspect, an impeller for a circumferential current pump including a motor unit section having a motor and a pump unit section operatively connected to the motor unit section through a driving shaft of the motor, the pump unit section including a pump casing, a pump cover and an impeller disposed in a space defined between the pump casing and the cover, the impeller comprising:

- a disc-shape member having two surfaces and operatively connected to the motor to be rotatable;
- a plurality of vane grooves formed to outer peripheral end portions of both the surfaces in a circumferential direction thereof; and
- a plurality of vanes arranged between the respective adjacent vane grooves along a radial direction of the disc-shape member,
- wherein each of the vanes has an upstream side surface and a downstream side surface in a rotating direction thereof and a center line between both these surfaces extends along a radial direction of the disc-shape member, the upstream side surface has a radially inside portion and a radially outside portion which are formed to be continuous so that the radially inside portion is in parallel to the center line and the radially outside portion is inclined forward in the rotating direction of the disc-shape member, and the downstream side surface is formed entirely to be parallel to the center line.

In this aspect, only the radially outside portion of the vane is formed to be inclined forward in the rotating direction of the disc-shape member, so that the mold releasing resistance after the injection molding of the impeller can be reduced and, hence, the defective deformation of the impeller due to such releasing resistance can be effectively prevented in comparison with a conventional structure of the impeller in which the upstream side surface of the vane in the rotating direction thereof is entirely inclined forward and the downstream side surface of the vane is entirely inclined in a direction reverse to the rotating direction thereof.

In another aspect of the present invention, there is also provided an impeller for a circumferential current pump including a motor unit section having a motor and a pump unit section operatively connected to the motor unit section through a driving shaft of the motor, the pump unit section including a pump casing, a pump cover and an impeller disposed in a space defined between the pump casing and the cover, the impeller comprising:

a disc-shape member having two surfaces and operatively connected to the motor to be rotatable;

a plurality of vane grooves formed to outer peripheral end portions of both the surfaces in a circumferential direction thereof; and a plurality of vanes arranged between the respective adjacent vane grooves along a radial direction of the disc-shape member, wherein each of the vanes has an upstream side surface and a downstream side surface in a rotating direction thereof and a center line between both these surfaces extends along a radial direction of the disc-shape member, the upstream and downstream side surfaces have radially inside portions and radially outside portions which are formed to be continuous respectively, the radially inside portions of the upstream and downstream side surfaces are formed to be parallel to the center line, the radially outside portion of the upstream side surface is inclined forward in the rotating direction and rotating direction of the disc-shape member, and the radially outside portion of the downstream side surface of the vane is formed to be inclined towards a direction reverse to the rotating direction.

In this aspect, only the radially outside portion of the upstream side surface is inclined forward in the rotating direction and only the radially outside portion of the downstream side surface of the vane is formed to be inclined towards a direction reverse to the rotating direction. Accordingly, the releasing resistance after the injection molding of the impeller can be reduced and the defective deformation due to the releasing resistance can be effectively prevented in comparison with a conventional structure of the impeller in which the upstream side surface of the vane in the rotating direction thereof is entirely inclined forward and the downstream side surface of the vane is entirely inclined in a direction reverse to the rotating direction thereof.

Furthermore, in a preferred example of the above aspects of the impeller for a circumferential current pump, the disc-shape member is formed of synthetic resin. The radially outside portion of the upstream side surface of the vane has an arc-shape.

The vane groove formed between the vanes has a radially inside end portion having corner portions, at least one of which is chamfered.

The chamfered structure can also reduce the mold releasing resistance and prevent an occurrence of defective deformation to the impeller due to the releasing resistance.

The nature and further characteristic features of the present invention will be made more clear from the following descriptions made with reference to the accompanying drawings.

DESCRIPTION OF THE PREFERRED EMBODIMENTS

Figure 1:
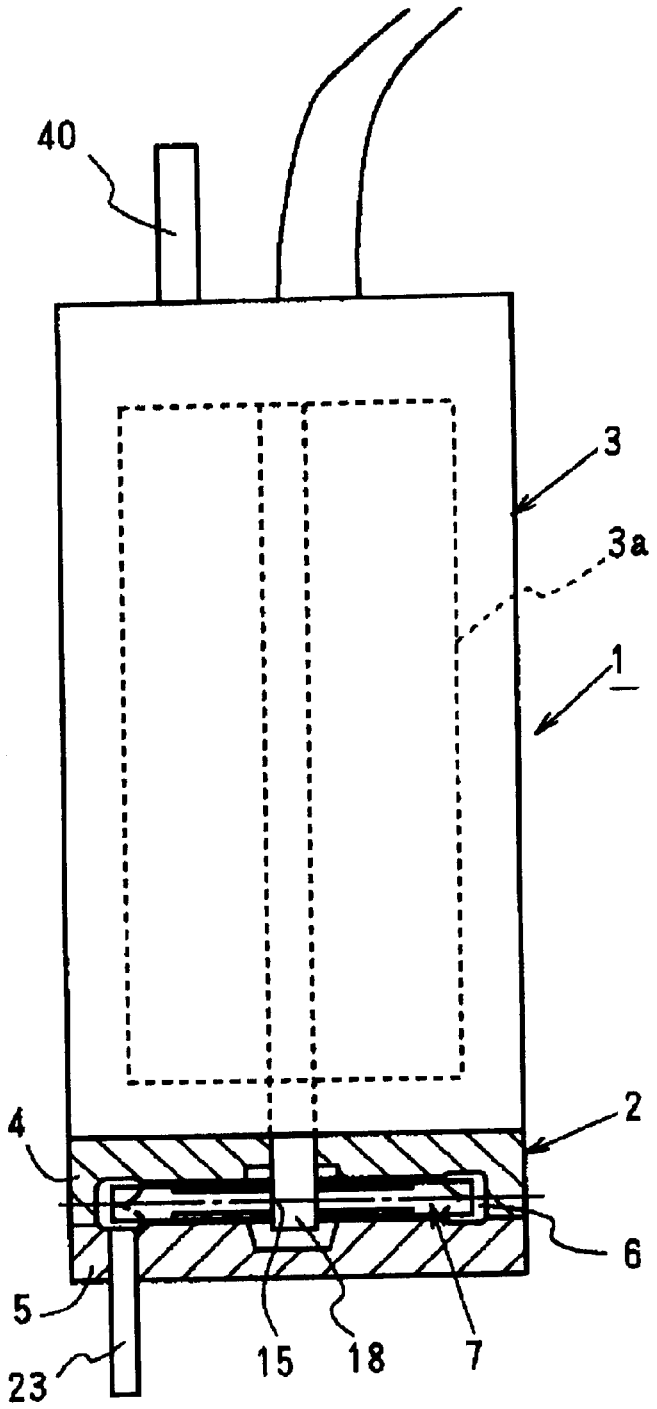
FIG. 1 is an illustrated front view, partially in section, showing a circumferential current pump according to a first embodiment of the present invention.

The present invention will be described hereunder with reference to various embodiments shown in the drawings.

[First Embodiment]

A first embodiment of a circumferential current pump 1 of the present invention will be first explained with reference to FIGS. 1 and 2.

Figure 2:
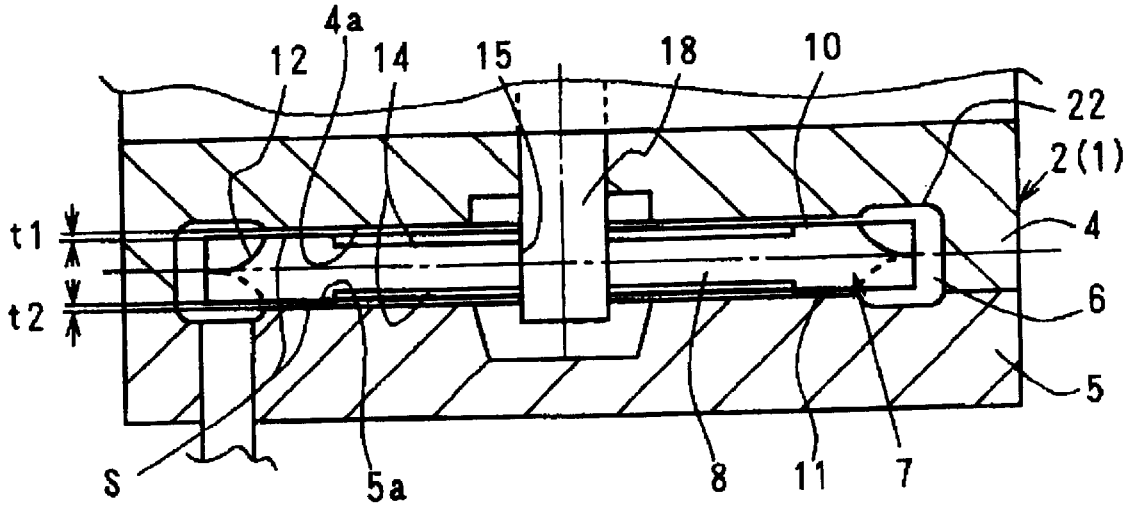
FIG. 2 is a sectional view of FIG. 1 in an enlarged scale.

As shown in FIGS. 1 and 2, the circumferential current pump 1 of this embodiment is composed of a pump (unit) section 2 and a motor (unit) section 3. In the illustrated state, the pump unit section 2 comprises a pump casing 4 disposed to the lower portion of the motor unit section 3, a pump cover 5 mounted to the lower surface side of the pump casing 4 and a substantially disc-shaped impeller 7 which is accommodated to be rotatable in a substantially disc-shaped space 6 defined between the pump casing 4 and the pump cover 5.

Since the impeller is disposed in a fuel tank, not shown, the impeller 7 is formed of a resin material such as phenol resin or PPS resin having an excellent resistance to solvent and manufactured through an injection molding process so as to provide a desired outer shape.

The impeller is provided with a plurality of vanes arranged at its outer peripheral surface with substantially equal intervous from each other. However, hereinlater, the vanes may be explained as a single vane for the sake of convenience for explanation, which will be applicable to the other all vanes.

Figure 5:
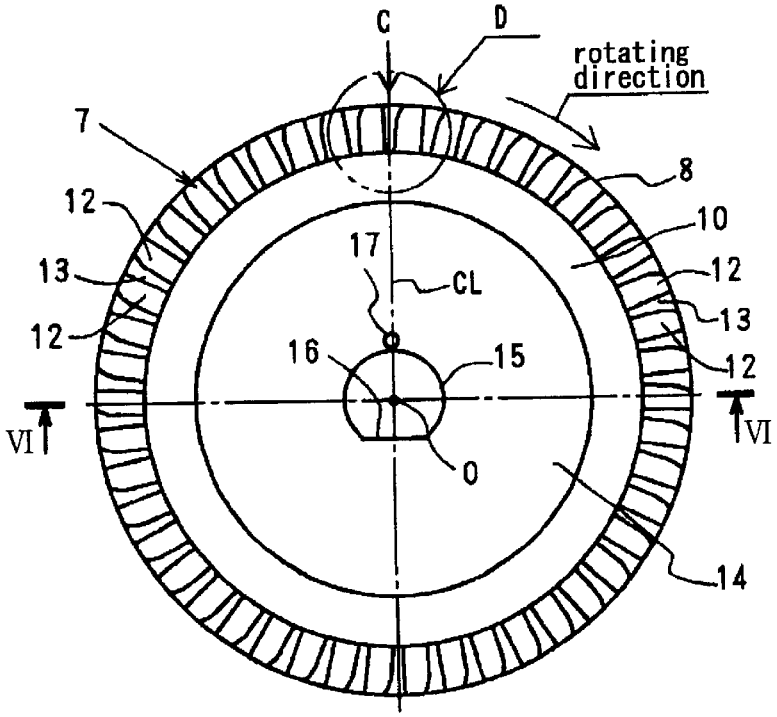
FIG. 5 is a side view of an impeller of the circumferential current pump of FIG. 1.

The details of the impeller 7 are shown in FIGS. 5–8 and 12, and with reference to these figures, the impeller 7 has a disc-shaped member 8. A plurality of vane grooves (grooves for vanes) 12 are formed to both side surfaces 10 and 11 of the outer peripheral end portion of the disc member 8, and each vane 13 is formed between the vane grooves 12, 12 so as to be offset by half pitch between one surface side 10 and the other surface side 11. Further, both the side surfaces 10 and 11 of the impeller 7 are formed with recesses (recessed portions) 14 each in shape of a circle having a predetermined radius with the rotational center being the center of this circle. A shaft hole 15 is also formed to the central portion of the impeller 7 and a pressure regulation hole 17 is formed to a portion near the shaft hole 15 so as to communicate with the recessed portions 14, 14 of the side surfaces 10 and 11 of the impeller 7. This pressure regulation hole 15 serves to make balance in pressures acting on both the surfaces 10 and 11 and makes it possible for the impeller 7 to be rotated in a state slightly apart from the pump casing 4 and the pump cover 5 as shown in FIG. 5.

Furthermore, a rotation preventing portion 16 is also formed so as to be engageable with a cutout, not shown, of a drive shaft 18 extending from a motor to receive a driving power from the motor in the state shown in FIGS. 1 and 2.

Figure 8:
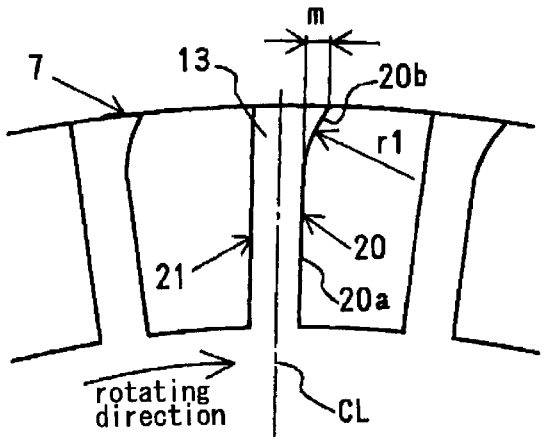
FIG. 8 is an enlarged view of a portion D of the impeller vane in FIG. 5.
Figure 9:
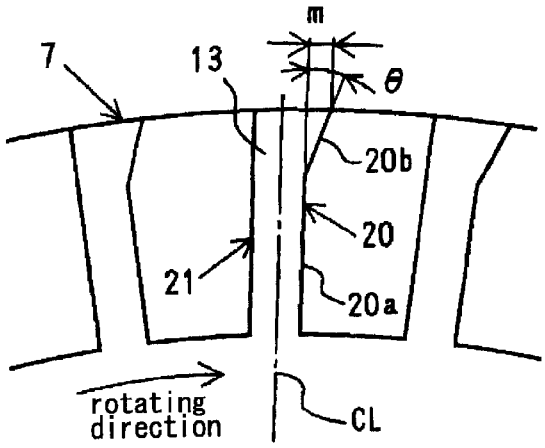
FIG. 9 is an illustration of a first modified example of the impeller vane shape of FIG. 8.

The respective vane grooves 12 adjacent to each other in the circumferential direction of the impeller 7 are sectioned by the vane 13, and the vane 13 is formed so that the central line CL thereof extends, as shown in FIGS. 5 and 8, along a radial direction extending from the rotation center O of the impeller 7. The vane 13 is also formed so that a radially inside portion 20*a* of an upstream side surface 20 in the rotational (rotating) direction of the impeller 7 is parallel to the central line CL thereof and a radially outside portion 20*b* of the upstream side surface 20 of the impeller 7 is inclined forward in the rotational direction. Furthermore, the vane 13 is formed so that a downstream side surface 21 in the rotational direction of the impeller 7 is parallel to the central line CL of the vane 13. It is desired for the radially outside portion 20*b* of the upstream side surface 20 to have a shape for smoothly guiding the fuel flow towards the radially outside from the radially inside by means of centrifugal force, and although, preferably an arc shape such as shown in FIG. 8 is desired, a linear shape (FIG. 9) or combined shape of arc-and-line (not shown) may be also utilized.

Figure 6:
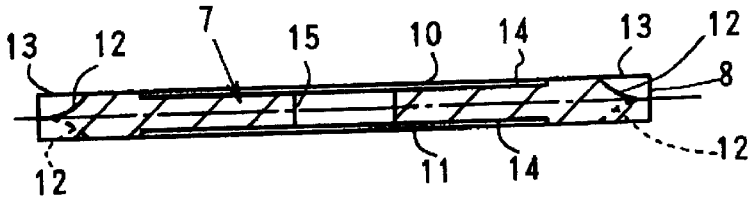
FIG. 6 is a sectional view taken along the line VI—VI in FIG. 5.
Figure 7:
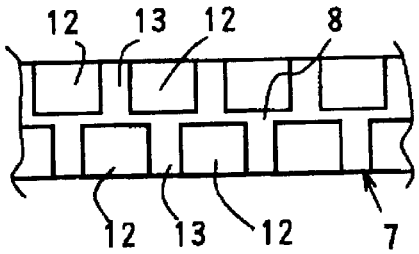
FIG. 7 is a view seen from a direction C (outer peripheral surface side) in FIG. 5, showing a vane groove of the impeller.

The vane groove 12 has a radially inside end portion cut out in an approximately arc-shape as shown in FIGS. 2 and 6 so as to smoothly receive the fuel into the vane groove 12 from the radially inside end portion of the vane groove 12 and, thereafter, to smoothly flow out the fuel into a pump passage 22 from the radially outside end portion of the vane groove 12. Furthermore, with reference to FIGS. 8 and 9, a circumferential length m, a radius of an arc r1 and an inclination angle θ of the radially outside portion (inclined portion) 20*b* of the upstream side surface 20 of the impeller 7 will be properly determined in consideration of the sizes or shapes of the vane 13 and the vane groove 12.

Figure 3:
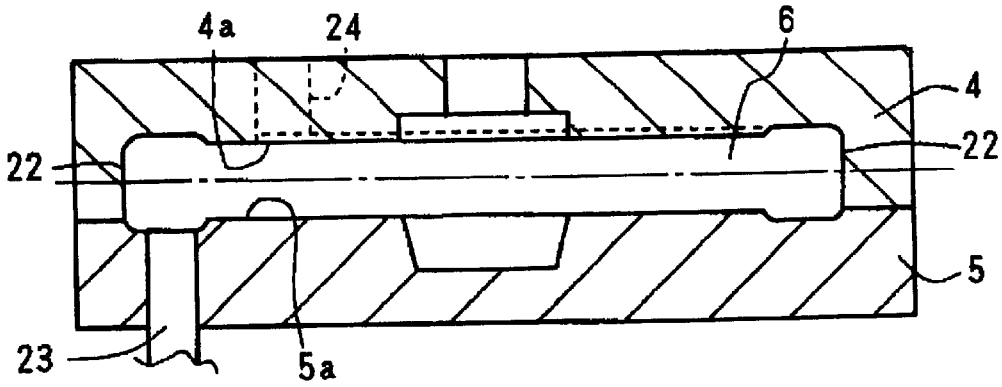
FIG. 3 is a sectional view showing an assembled state of a pump casing and a pump cover.

Hereunder, with reference to FIGS. 3 and 4, the relationship between the impeller 7 and the pump casing 4 and the pump cover 5 will be explained, in which FIG. 3 is a sectional view showing an assembled state of the pump casing and the pump cover and FIG. 4 is a plan view showing an arrangement in relation to the pump passage 22, a fuel flow-in passage 23, a fuel flow-out passage 24 and the impeller 7.

As shown in these figures, a space 6 having approximately a disc-shape is formed to a mating surface of the pump casing 4 and the pump cover 5 so as to house the impeller 7 therein to be rotatable, and the pump passage 22 mentioned above formed on the outer peripheral side of this disc-shaped space 6 is communicated with the fuel flow-in passage 23 formed to the pump cover 5 and also with the fuel flow-out passage formed to the pump casing 4.

Figure 4A:
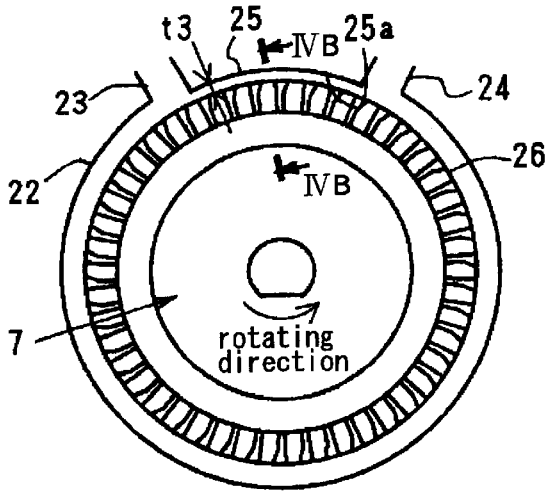
FIG. 4A is a plan view for explaining an operation of the circumferential current pump of FIG. 1
Figure 4B:
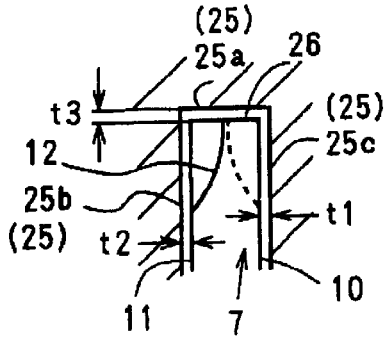
FIG. 4B is a sectional view taken along the line IVB—IVB in FIG. 4A.

These fuel flow-in passage 23 and fuel flow-out passage 24 are sectioned by a partition section 25, and as shown in FIGS. 4A and 4B, the partition section 25 has an inner peripheral wall 25*a* which is engageable with the outer peripheral surface 26 of the impeller 7 with a small gap t3 and both side walls 25*b* and 25*c* are engageable with the side surfaces 10 and 11 of the impeller 7 with small gaps t1 and t2 therebetween. Furthermore, the partition section 25 constituting a sealing structure for preventing the fuel from leaking from the fuel flow-out passage 24 (high pressure side) towards the fuel flow-in passage 23 (low pressure side) is in operative association with the outer peripheral surface 26 and both the side surfaces 10 and 11.

Furthermore, as shown in FIG. 2, a seal portion S is formed to one side surface 10 of the impeller 7 and a small gap is formed between this seal portion S and a wall section 4*a* of the pump casing 4 so as to have a width (dimension) t1. A seal portion S is also formed to the other one side surface 11 of the impeller 7 and a small gap is formed between this seal portion S and a wall section 5*a* of the pump cover 5 so as to have a width (dimension) t2. According to such structure, the fuel in the pump passage 22 is prevented from leaking to the rotational center side O of the impeller 7, thus also providing a sealing structure.

Figure 13:
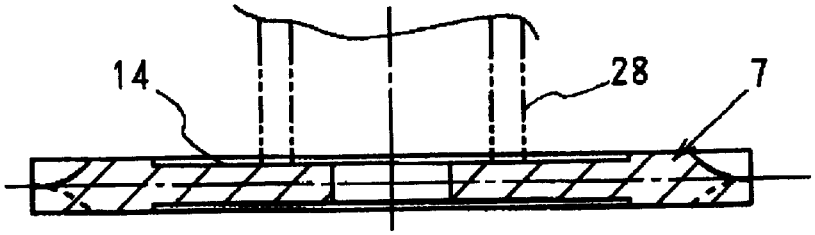
FIG. 13 is a sectional view showing a relation between the impeller and a ring gate, i.e. sectional view taken along the line XIII—XIII in FIG. 14.
Figure 14:
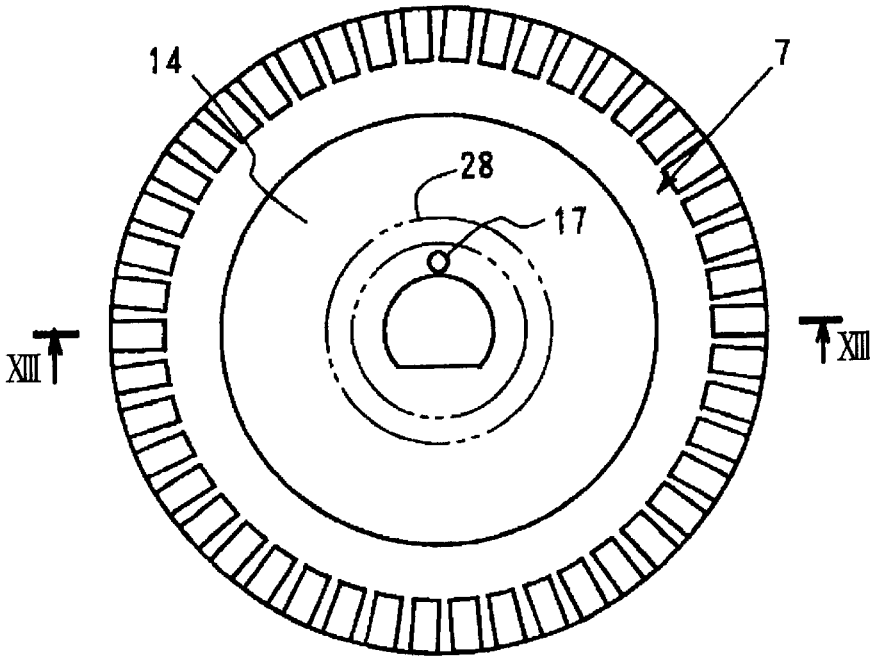
FIG. 14 is a plan view showing the relation between the impeller and the ring gate.
Figure 15:
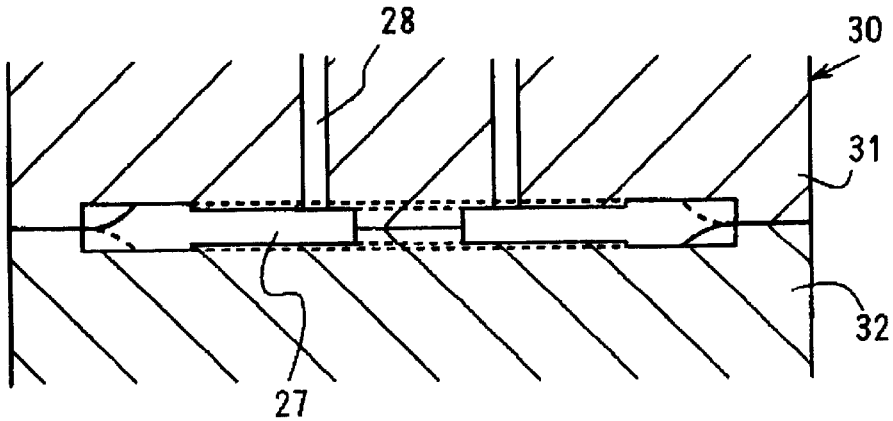
FIG. 15 is an illustrated sectional view showing one example of an injection molding mold.

FIGS. 13 to 15 represent an impeller molding method, and with reference to these figures, a ring gate 28 for injecting synthetic resin into a cavity 27 of a mold for molding the impeller 7 is arranged to a portion corresponding to the recessed portion 14 of the impeller 7. Such mold is shown in FIG. 15 as one example of injection molding mold 30. This injection molding (forming) mold 30 is a splittable type having upper and lower mold halves 31 and 32 and the cavity 27 is formed to the joining surface between the upper and lower mold halves 31 and 32. The ring gate 28 is formed so as to be opened to the cavity 27 corresponding to the recessed portion 14 of the impeller 7.

Figure 16:
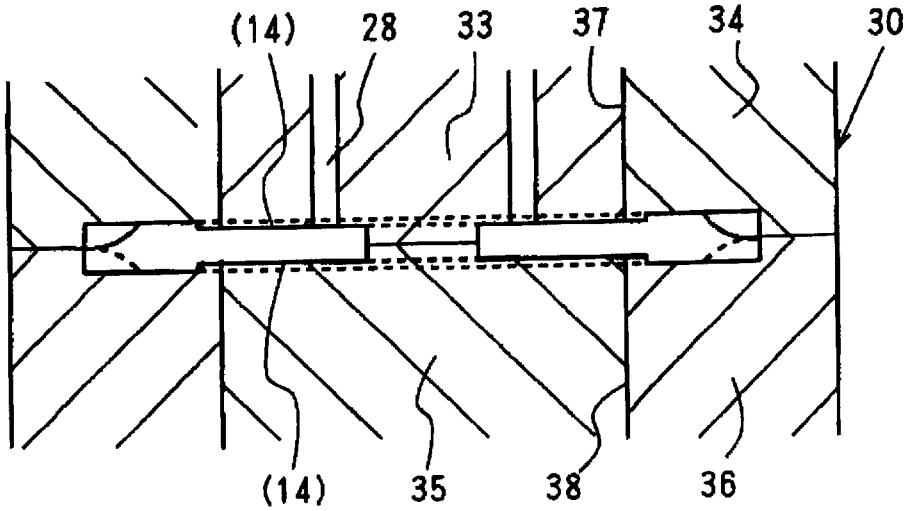
FIG. 16 is an illustrated sectional view showing another example of an injection molding mold.

FIG. 16 also shows another example of the injection molding mold 30, which is composed of a first upper mold half 33 forming the recessed portion 14 of the impeller 7, a second upper mold half 34 arranged on the outer peripheral side of the first upper mold half 33, a first lower mold half 35 forming the recessed portion 14 of the impeller 7 and a second lower mold half 36 arranged on the outer peripheral side of the first lower mold half 35. A separation (joining) surface 37 between the first and second upper mold halves 33 and 34 and a separation (joining) surface 38 between the first and second lower mold halves 35 and 36 are positioned to the recessed portions 14 of the impeller 7, and the ring gate 28 is formed to the first upper mold half 33.

According to the impeller molding method concerning the example of FIG. 16, the upper mold includes first and second upper mold halves 33 and 34 and the lower mold includes the first and second lower mold halves 35 and 36, and their separating surfaces 37 and 38 and the ring gate 28 are positioned to the recessed portions 14, so that the generation of burr, which may easily be generated at a boundary portion between the seal portions S (side surfaces 10 and 11) of the impeller 7 and the recessed portions 14, can be effectively prevented, and burr or surface coarse portion, which is generated at the separation surfaces 37 and 38 and the separation surface of the ring gate 28, may be received in the recessed portions 14.

Accordingly, a profile irregularity of the side surfaces 10 and 11 (seal portions S) of the impeller 7 are not made worse and the generation of the burr is free from consideration, and hence, the gaps t1 and t2 on both the side surface sides 10 and 11 are not increased, thus being convenient and advantageous. Therefore, according to the molding method of the impeller 7 of the embodiment of FIG. 16, the impeller 7 after the injection molding can be utilized as it is without carrying out specific finishing working such as grinding working to the side surfaces 10 and 11 and the outer peripheral surface 26 of the impeller 7. Thus, the manufacturing process can be made simple, being economical.

Furthermore, since the impeller 7 of the described embodiment is formed so that only the radially outside portion 20*b* of the upstream side surface 20 of the vane 13 is inclined forward, there is less portion clamping the mold, in comparison with the first example (1) of the prior art mentioned hereinbefore, even if the vane 13 is contracted in the radial direction after the injection molding process and, hence, the mold releasing resistance can be made small in comparison with the prior art first example (1).

Figure 22A:
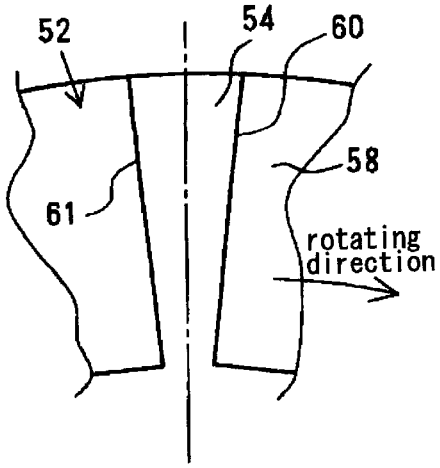
FIG. 22 is an enlarged view of a portion F in FIG. 21 and includes FIG. 22A showing an impeller vane in an enlarged scale and FIG. 22B showing a modification of the vane after the injection molding.
Figure 22B:
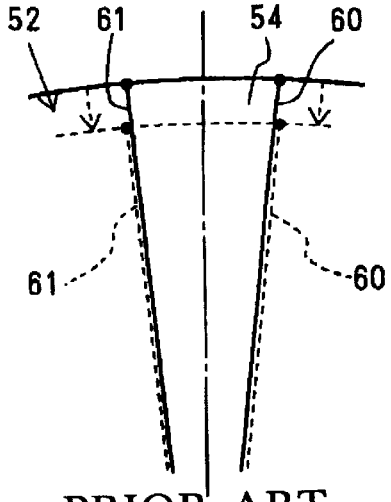
PRIOR ART FIG.22B

In the first example (1) shown in FIGS. 22A and 22B, the upstream side surface 60 of the vane 54 in the rotating (rotational) direction is entirely inclined forward towards the rotating direction and, on the other hand, the downstream side surface 61 of the vane 54 in the rotating (rotational) direction is entirely inclined in the direction reverse to the rotating direction. Moreover, the root portion of the vane 54 is made more fine than the outer peripheral side front end portion of the vane 54, so that if the impeller 52 is deformed and contracted after the injection molding process (deformation from the solid line position to the dotted line position), the mold is clamped by the entire surface areas of the surfaces 60 and 61 of the adjacent vanes 54, 54, and hence, it becomes difficult to release the impeller 52 from the mold, and the impeller 52 may be deformed by the releasing resistance at that time. In such prior art first example (1), since the profile irregularity of the impeller 54 is made worse, it is difficult to utilize the impeller 54 as it is only after the injection molding and the grinding working is required. However, according to the present invention, the mold releasing resistance can be reduced in comparison with the prior art first example (1) and the defective deformation of the impeller 7 can be prevented from being caused. Therefore, the impeller 7 can be utilized as it is after the injection molding without carrying out any grinding working with reduced manufacturing cost, thus being advantageous. Accordingly, an improved circumferential current pump including such impeller 7 can be cheaply manufactured.

The function and effect of the circumferential current pump of the structure mentioned above will be described hereunder.

With reference to FIGS. 1 to 4, according to the embodiment of the present invention, when the impeller 7 is driven through the operation of the motor 3*a* of the motor unit 3, the fuel in the fuel tank, not shown, flows into the pump passage 22 through the fuel flow-in passage 23, a kinetic energy is given to the fuel from the rotating impeller 7 and the fuel is then increased in pressure by the impeller 7 during the movement to the fuel flow-out passage 24 along the annular pump passage 22. The fuel increased in pressure then passes through a flow passage, not shown, of the motor unit 3 and is fed to an engine of a vehicle, for example, through the fuel drain port 40.

During this pump operation period, because the vane 13 of the impeller 7 is formed with the radially outside portion 20*b* of the rotating direction upstream side surface 20 is, inclined forward, the kinetic energy directing the rotating direction of the impeller 7 is given to the fuel flowing into the pump passage 22 through the vane groove 12 by means of the centrifugal force. As a result, according to the circumferential current pump 1 of the described embodiment, the shutout drain pressure can be increased by an amount corresponding to the increasing in speed of the fuel towards the rotating direction in comparison with the prior art first example (1).

Figure 23A:
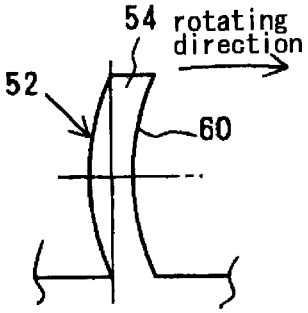
PRIOR ART FIG.23A
FIGS. 23A and 23B represent second and third conventional examples showing the impellers having different vane shapes.
Figure 23B:
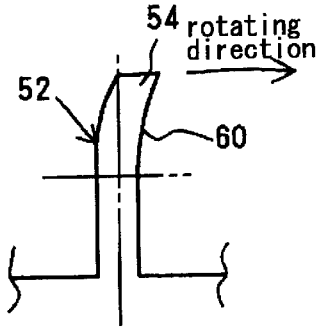
PRIOR ART FIG.23B
Figure 24:
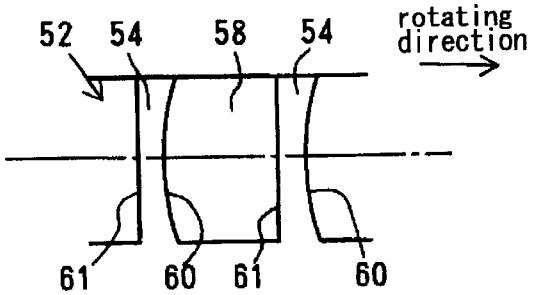
PRIOR ART FIG.24
FIG. 24 is a view showing the vane shape of the impeller of a fourth example of the conventional structure.

Furthermore, in the vane 13 of the impeller 7 of the present embodiment, the downstream side surface 21 in the rotating direction of the vane 13 is formed to be entirely parallel to the central line CL, the radially inside portion 20*a* of the upstream side surface 20 in the rotating direction is formed to be parallel to the central line CL, and the radially outside portion 20*b* of the upstream side surface 20 is formed so as to be inclined forward in the rotating direction. Therefore, the circumferential width at the outer peripheral end portion of the vane 13 of the impeller 7 can be made widened in comparison with the prior art second and third examples (2) and (3) mentioned hereinbefore (FIGS. 23A and 23B), in which the circumferential width of the vane 54 of the impeller 52 is made constant. Accordingly, in comparison of the circumferential current pump 1 of the present invention with those of the prior art examples (2) and (3), in the present invention, the slide-contact area in a unit time between the partition wall section 25 and the outer peripheral surface 26 and both the side surfaces 10, 11 of the vane 13 of the impeller 7 can be made large by an amount corresponding to the widened circumferential width of the outer peripheral end portion of the vane 13. As a result, the circumferential current pump 1 of this embodiment can attain an improved sealing performance of the partition wall section 25, and hence, the shutout drain pressure can be made large in comparison with the prior art examples (2) and (3). More particularly, since the area of the outer peripheral surface 26 of the vane 13 can be made large, the sealing performance between the inner peripheral wall 25*a* of the partition wall section 25 and the outer peripheral surface 26 of the vane 13 can be improved.

Still furthermore, the vane 13 is formed so that only the radially outside portion 20*b* of the upstream side surface 20 is formed so as to be inclined forward in the rotating direction, that is, the circumferential width on the root side portion of the vane 13 is formed to be narrow, so that the volume of the vane groove 12 can be made large in comparison with the vane 54 of the prior art fourth example (4) in which the entire upstream side surface 60 in the rotating direction is bent, and therefore, according to the present invention, the pumping efficiency can be improved more than that of the prior art example (4).

Figure 10:
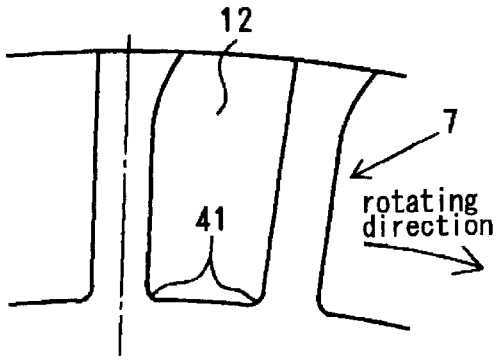
FIG. 10 is an illustration of a second modified example of the impeller vane shape of FIG. 8.
Figure 11:
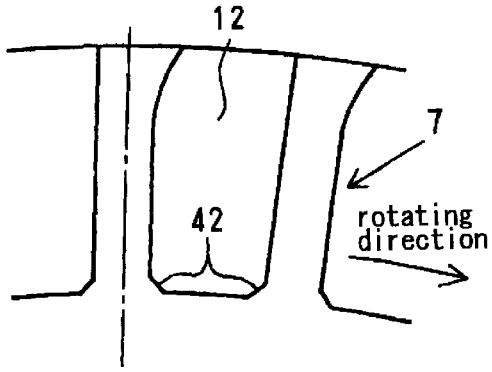
FIG. 11 is an illustration of a third modified example of the impeller vane shape of FIG. 8.
Figure 12:
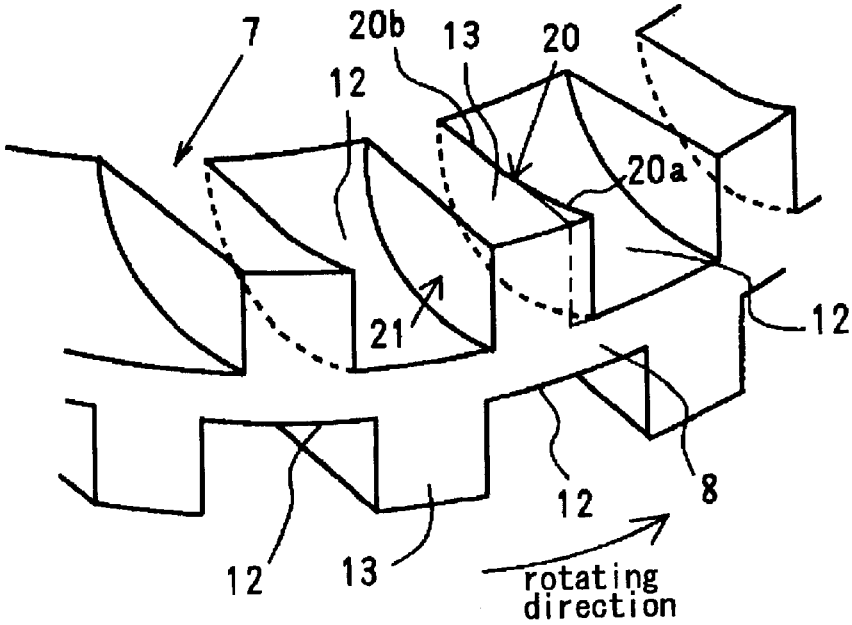
FIG. 12 is a perspective view of an outer appearance of a portion of an outer peripheral end portion of the impeller.

In addition, in the described embodiment, as shown in FIGS. 10 and 11, it may be possible to form two chamfered (R) portions 41 or form two chamfered (C) portions 42 (FIG. 11) to corner portions of the bottom of the vane groove 12 of the impeller 7, so that the impeller can be easily released from the mold with reduced possibility of deformation or defective releasing of the impeller 7. Further, although, in FIGS. 10 and 11, both the corner portions are chamfered, it may be adopted that at least one corner portion is chamfered.

[Second Embodiment]

Figure 17:
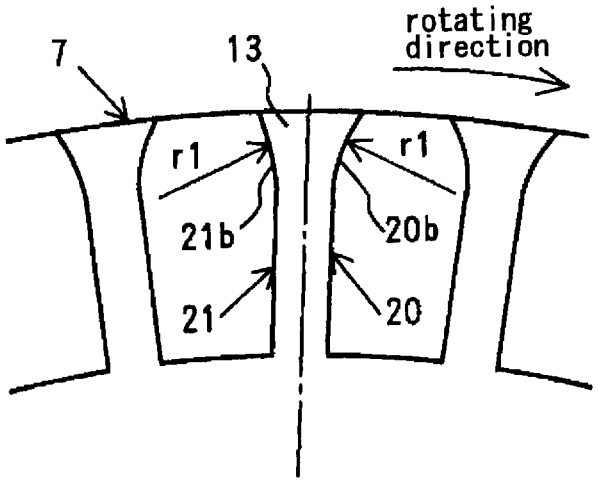
FIG. 17 is an enlarged view of a portion of an impeller according to a second embodiment of the present invention.
Figure 18:
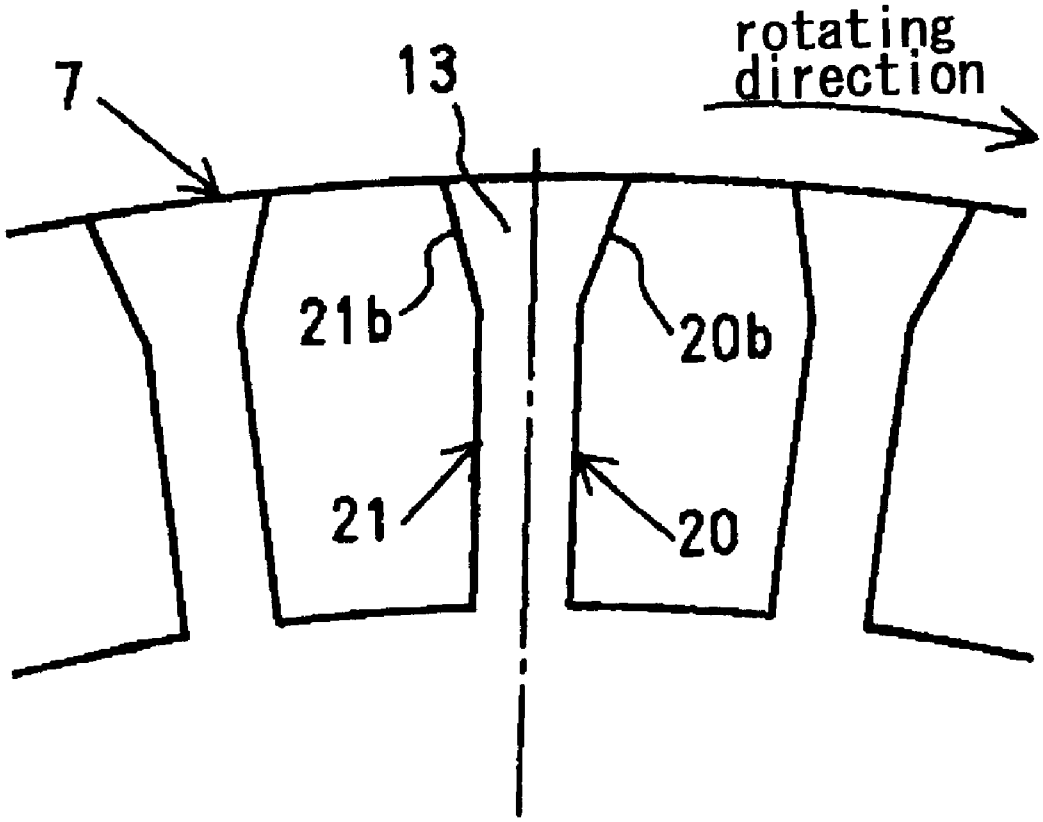
FIG. 18 is a view showing a modified example of the impeller shown in FIG. 17.
Figure 19:
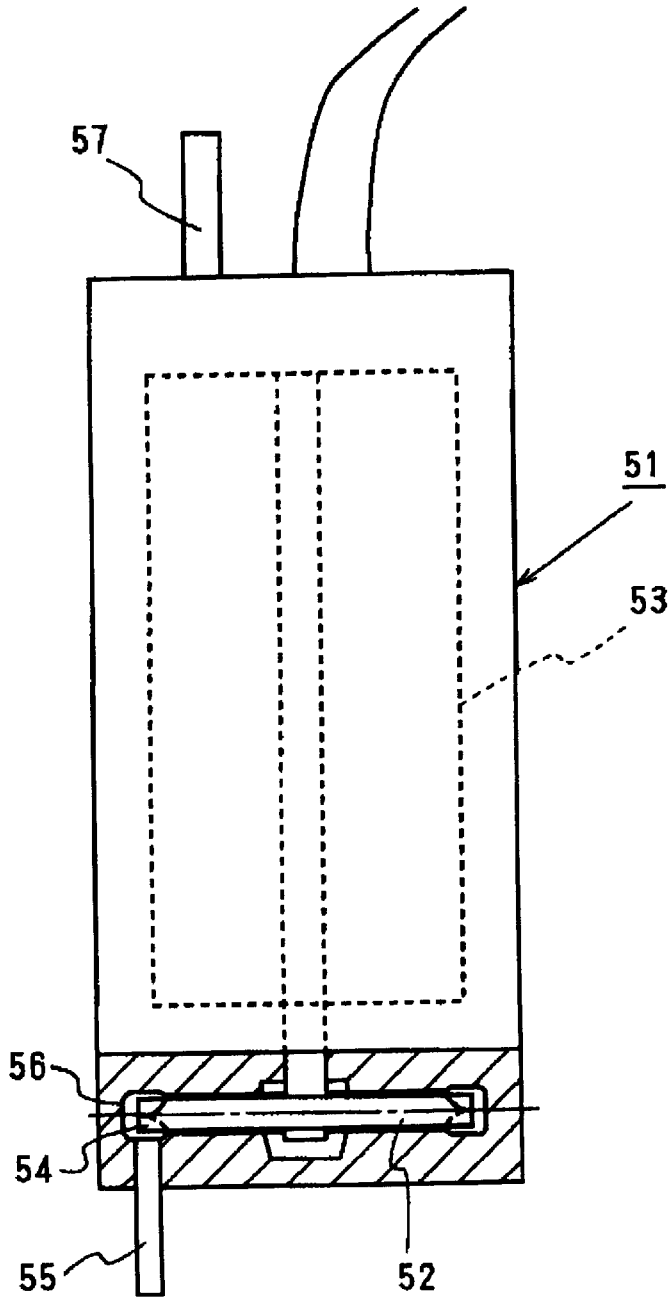
FIG. 19 is an illustrated front view, partially in section, showing a circumferential current pump of a conventional structure.
Figure 20:
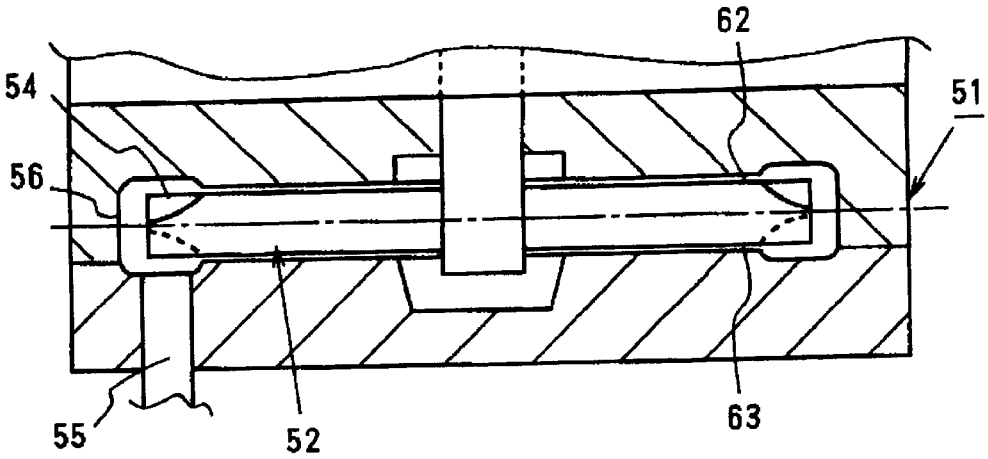
FIG. 20 is a sectional view of a portion of FIG. 1 in an enlarged scale.
Figure 21:
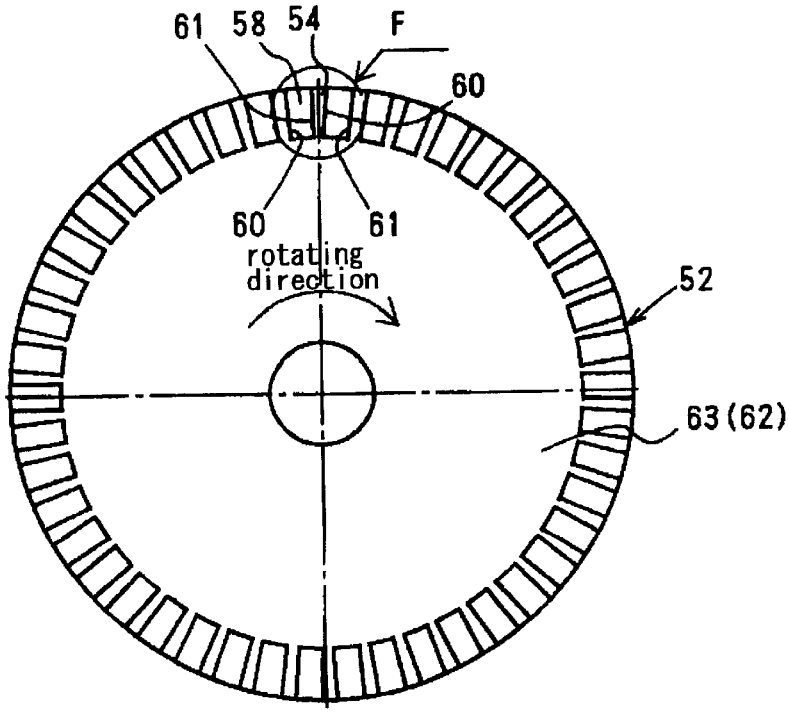
PRIOR ART FIG.21
FIG. 21 is a side view of an impeller of a first conventional structure.

FIGS. 17 and 18 represent a second embodiment of the present invention, which differs from the former first embodiment in the structure (shape) of the vane 13 of the impeller 7 and the other structures of the circumferential current pump 1 are substantially the same as those of the first embodiment. Thus, the like reference numerals are added to portions or members corresponding to those of the first embodiment and detailed explanations thereof are hence omitted herein.

With reference to FIGS. 17 and 18, the vane 13 of the impeller 7 of the second embodiment has a structure such that the radially outside portion 20*b* of the upstream side surface 20 in the rotating direction thereof is inclined forward to the upstream side in the rotating direction and, in addition, the radially outside portion 21*b* of the downstream side surface 21 in the rotating direction thereof is inclined to the direction reverse to the rotating direction so that the outer peripheral end portion of the vane 13 has a thickness larger than the root portion of the vane 13.

Concerning the impeller 7 shown in FIG. 17, the radially outside portion 20*b* of the upstream side surface 20 and the radially outside portion 21*b* of the downstream side surface 21 are each formed so as to provide a round (R) shape having a radius of curvature of r1, and concerning the impeller 7 shown in FIG. 18, the radially outside portion 20*b* of the upstream side surface 20 and the radially outside portion 21*b* of the downstream side surface 21 are each formed so as to provide a plane shape.

According to the impeller of this second embodiment, the impeller 7 has the same front and rear shapes in the rotating direction, so that there is no occurrence of defective operation caused by erroneous mounting of the impeller 7 to a motor driving shaft 18. Thus, according to this embodiment, the impeller can be easily mounted, thus being convenient.

Furthermore, since only the radially outside portions 20*b* and 21*b* of the upstream and downstream side surfaces 20 and 21 are inclined, reduced portions of the vanes 13 pressurize and clamp the mold in comparison with the prior art first example (1) even if the impeller 7 is contracted towards the rotational center side through the cooling after the injection molding (FIG. 22), and hence, the mold releasing resistance can be made small. Accordingly, the impeller 7 can be easily released from the mold after the injection molding, thus preventing the generation of the defective product of the impeller resulted from the releasing resistance.

Still furthermore, according to this second embodiment, as like as in the first embodiment, the kinetic energy directing to the rotating direction of the impeller 7 is imparted to the fuel by the portion inclining towards the rotating direction thereof, so that the flow speed of the fuel in the rotating direction can be increased and the shutout drain pressure can be increased much than that in the first embodiment. Moreover, the vane 13 of the impeller 7 of this embodiment has a width dimension of the peripheral end portion larger than that of the first embodiment, so that the sealing effect of the partition wall section 25 and the shutout drain pressure can be further increased with the shutout drain pressure increasing due to the increasing of the fuel flow speed, thus being convenient and advantageous.

Still furthermore, the example of FIG. 17, in which the radially outside portions 20*b* and 21*b* are formed to be round (R-shape), can easily apply a swivel flow to the fuel in comparison with the example of FIG. 18, in which these portions 20*b* and 21*b* are formed to be plane.

In the respective embodiments, since the front end portion of the vane 13 is formed so that the width thereof is thickened, the rigidity of this portion can be improved.

It is further to be noted that the present invention is not limited to the described embodiments and many other changes and modifications may be made without departing from the scopes of the appended claims.

What is claimed is:

1. An impeller for a circumferential current pump including a motor unit section having a motor and a pump unit section operatively connected to the motor unit section through a driving shaft of the motor, the pump unit section including a pump casing, a pump cover and the impeller disposed in a space defined between the pump casing and the cover, said impeller comprising:

a disc-shape member having two side surfaces and operatively connected to the motor to be rotatable;

a plurality of vane grooves formed to outer peripheral end portions of both the side surfaces in a circumferential direction thereof; and a plurality of vanes arranged between the respective adjacent vane grooves along a radial direction of the disc-shape member, wherein each of said vanes has an upstream side surface and a downstream side surface in a rotating direction thereof and a center line between both these surfaces extends along a radial direction of the disc-shape member, said upstream side surface has a radially inside portion and a radially outside portion which are formed to be continuous so that said radially inside portion is in parallel to said center line and said radially outside portion is inclined forward in the rotating direction of the disc-shape member, and said downstream side surface is formed entirely to be parallel to said center line.

2. An impeller for a circumferential current pump according to claim 1, wherein said disc-shape member is formed of synthetic resin.

3. An impeller for a circumferential current pump according to claim 1, wherein said radially outside portion of the upstream side surface of the vane has an arc-shape.

4. An impeller for a circumferential current pump according to claim 1, wherein said vane groove formed between the vanes has a radially inside end portion having corner portions, at least one of which is chamfered.

5. An impeller for a circumferential current pump including a motor unit section having a motor and a pump unit section operatively connected to the motor unit section through a driving shaft of the motor, the pump unit section including a pump casing, a pump cover and the impeller disposed in a space defined between the pump casing and the cover, said impeller comprising:

a disc-shape member having two side surfaces and operatively connected to the motor to be rotatable;

a plurality of vane grooves formed to outer peripheral end portions of both the side surfaces in a circumferential direction thereof; and a plurality of vanes arranged between the respective adjacent vane grooves along a radial direction of the disc-shape member, wherein each of said vanes has an upstream side surface and a downstream side surface in a rotating direction thereof and a center line between both these surfaces extends along a radial direction of the disc-shape member, said upstream and downstream side surfaces have radially inside portions and radially outside portions which are formed to be continuous respectively, said radially inside portions of the upstream and downstream side surfaces are formed to be parallel to said center line, said radially outside portion of the upstream side surface is inclined forward in the rotating direction of the disc-shape member, and said radially outside portion of the downstream side surface of the vane is formed to be inclined towards a direction reverse to the rotating direction.

6. An impeller for a circumferential current pump according to claim 5, wherein said disc-shape member is formed of synthetic resin.

7. An impeller for a circumferential current pump according to claim 5, wherein said radially outside portion of the upstream side surface of the vane has an arc-shape.

8. An impeller for a circumferential current pump according to claim 5, wherein said vane groove formed between the vanes has a radially inside end portion having corner portions, at least one of which is chamfered.

* * * * *